US005515996A

United States Patent [19]

Stone

[11] Patent Number: 5,515,996

[45] Date of Patent: May 14, 1996

[54] FLIP-TOP RECLOSEABLE CONTAINER WITH POSITIVE CLOSURE ARRANGEMENT

[75] Inventor: James L. Stone, Grand Rapids, Mich.

[73] Assignee: Packaging Corporation of America, Evanston, Ill.

[21] Appl. No.: 254,142

[22] Filed: Jun. 6, 1994

[51] Int. Cl.[6] ..... B65D 90/04

[52] U.S. Cl. ..... 220/416; 229/125.26; 229/225

[58] Field of Search ..... 229/224, 225, 229/125.26, 933, 935, 145, 141; 220/408, 410, 416

[56] References Cited

U.S. PATENT DOCUMENTS

| | | | |
|---|---|---|---|
| 2,717,074 | 9/1955 | Williamson et al. | 229/125.26 |
| 2,951,627 | 9/1960 | Wenzel | 229/225 |
| 3,756,501 | 9/1973 | Skillen et al. | 229/141 X |
| 3,910,486 | 10/1975 | Stone . | |
| 3,963,173 | 6/1976 | Stone . | |
| 4,141,449 | 2/1979 | Stone . | |
| 4,531,669 | 7/1985 | Osborne | 229/125.26 |
| 4,732,315 | 3/1988 | Gunn . | |
| 4,773,542 | 9/1988 | Schillinger et al. . | |
| 4,986,420 | 1/1991 | Gunn et al. . | |
| 4,997,087 | 3/1991 | Lorenz | 229/935 X |
| 5,148,973 | 9/1992 | Zimmermann | 229/125.26 X |
| 5,154,343 | 10/1992 | Stone . | |
| 5,161,734 | 11/1992 | Ruehl et al. . | |
| 5,236,123 | 8/1993 | Stone et al. . | |
| 5,265,799 | 11/1993 | Stone . | |
| 5,314,114 | 5/1994 | Stone | 229/225 |
| 5,322,215 | 6/1994 | Roccaforte | 229/225 |
| 5,373,960 | 12/1994 | Gunn et al. . | |

*Primary Examiner*—Allan N. Shoap
*Assistant Examiner*—Christopher J. McDonald
*Attorney, Agent, or Firm*—Arnold, White & Durkee

[57] ABSTRACT

A recloseable container comprises an outer carton and a liner constructed and arranged for placement within the carton. The carton includes opposing top and bottom walls, opposing front and back walls, and opposing first and second side walls. The first and second side walls and the front wall include a continuous horizontal tear strip for opening up the carton from a sealed form to form a lid hingedly attached to a base section. The liner includes a front panel and opposing first and second side sections for fitting the liner within the carton. The first and second side sections include respective first and second side panels having outer surfaces adjacent inner surfaces of the respective first and second carton side walls. Each of the first and second liner side sections includes a hinged portion and an island portion disposed in forcibly displaceable mutual engagement such that opening the container lid exerts a force which disengages the mutual engagement between the hinged portion and the island portion, and reclosing the lid leads to snap re-engagement of the hinged portion and the island portion.

16 Claims, 4 Drawing Sheets

FLIP-TOP RECLOSEABLE CONTAINER WITH POSITIVE CLOSURE ARRANGEMENT

FIELD OF THE INVENTION

The present invention relates generally to paperboard or corrugated containers, cartons, and the like. More specifically, the present invention relates to a flip-top recloseable container having a positive closure arrangement.

BACKGROUND OF THE INVENTION

In many consumer packaging applications, it is important to have paperboard or corrugated containers which are capable of being conveniently, yet securely, opened and reclosed repeatedly. This is particularly important where the container is used for storage of granular or powdered material, such as laundry detergent powder. Various approaches have been undertaken to address the repeated opening and closing/locking requirements by means of container designs using different types of interlocking flaps.

One exemplary recloseable container design, for instance, uses a container lid which hingedly attaches to the back panel of the base of the container. In such packages or containers, an integral tear strip is generally used to permit the opening of the lid. The lid is separated from the base section of the container by removing the tear strip and lifting the lid up. Subsequently, the container is reclosed by pushing the lid back down to its original position.

Conventional recloseable containers of the above-identified type suffer from disadvantages which severely restrict their use in certain consumer packaging applications, particularly where the packaged product constitutes granular or powdered material such as concentrated laundry detergent powder or the like. The present inventor has discovered that a major drawback in this regard is the general absence of a positive locking arrangement in combination with a container design which is conducive to repeated open and reclose operations. More specifically, the previously discussed exemplary design has been found to be unacceptable in certain applications because of the likelihood of the lid opening by itself and leading to spillage of the contents thereof when such a closed container is tipped over or otherwise disposed at an acute angle.

The present inventor has also discovered that such recloseable container can be improved by providing some form of positive indication, either tactile or audible, that an opened container has been reclosed adequately in order to realize an effective locking position. It has been determined in this regard that the presence of such tactile or audible feedback indicative of effective locking is desirable because the presence thereof provides consumers with a high "comfort" factor with respect to reclosure. Particularly in applications where the recloseable containers are used to contain liquids or to house granulated material having a restricted storage life once the storage container has been tom open, such positive feedback has been determined to provide an apparent sense of reassurance to consumers as to retention of "safety", "freshness", or scent of the contained product.

Accordingly, there exists a distinct need for a recloseable, flip-top container design which overcomes disadvantages of the above type associated with conventional recloseable containers. The present invention effectively and conveniently realizes such a recloseable container.

SUMMARY OF THE INVENTION

In accordance with the foregoing, an object of the present invention to provide a container of the flip-top type which is repeatedly recloseable by means of a positive locking arrangement.

A related object of the present invention is to provide a flip-top recloseable container which includes a positive locking arrangement adapted to provide positive tactile and/or audible feedback indicative of effective closure.

Another object of the present invention is to provide a flip-top recloseable container which is particularly adapted to contain granular or powdered material in the form of an enclosure which is easily assembled and conveniently opened and reclosed for effective dispensing of material contained therein.

A further object of the present invention is to provide a flip-top recloseable container which is realized using an efficient and cost-effective manufacturing process.

In a particular embodiment, the above and other objects are realized by providing a recloseable container having a positive locking arrangement, with the container being adapted for effective containment of granular material and the locking arrangement providing positive feedback indicative of effective reclosure, as will be described in detail below in conjunction with the accompanying drawings. The recloseable container includes an outer carton in the form of a six-sided parallelopiped enclosure having opposing top and bottom walls, front and back walls, and first and second side walls formed from corresponding panels and flaps defined on a unitary, continuous paperboard blank. The side walls and the front wall are provided with horizontal tear-strip sections which define an integral and continuous tear strip that functions as convenient means for opening the container from its sealed form. The recloseable container further includes a liner constructed and arranged to provide structural support to the carton. The liner includes a front panel and opposing first and second side panels for fitting the liner snugly inside the carton.

Repeated closing and positive locking of the container is realized by means of first and second extension flaps hingedly connected to the upper edges of the respective first and second liner side panels and disposed adjacent the inner surfaces of the respective first and second carton side walls. Each of the extension flaps includes a proximal hinged portion and an island portion disposed in forcibly displaceable mutual engagement. Once the engaging hinged portion and island portion are disengaged forcibly by opening the container lid, reclosing thereof leads to snap re-engagement of the hinged and island portions accompanied by positive tactile and audible feedback indicative of effective container closure.

BRIEF DESCRIPTION OF THE DRAWINGS

Other objects and advantages of the invention will become apparent upon reading the following detailed description and upon reference to the drawings in which.

Figure 1:
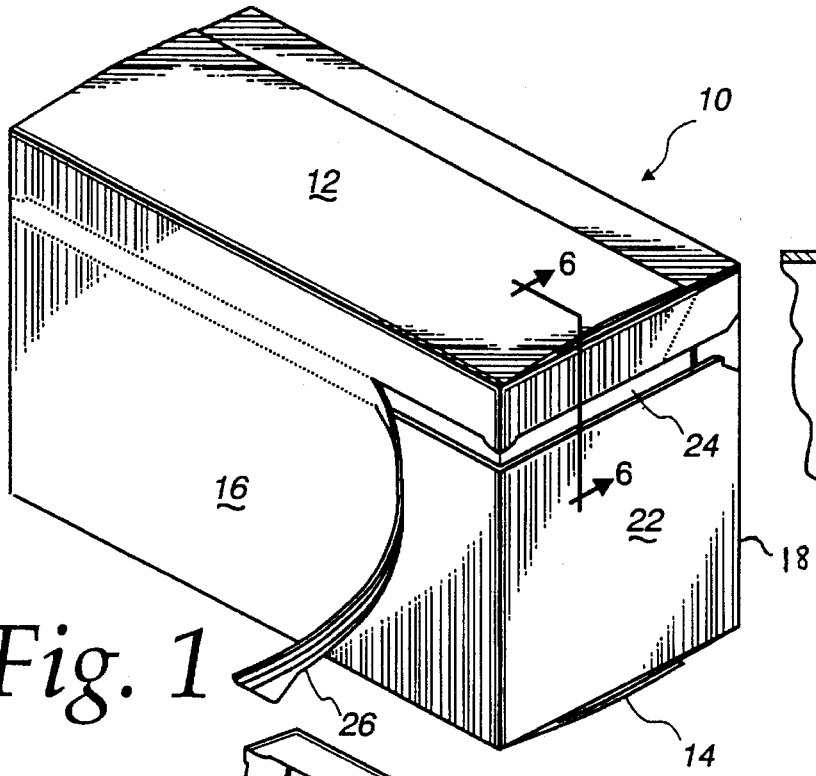
FIG. 1 is a perspective view of a recloseable container embodying the present invention, showing the container in its closed form with the tear strip partially pulled open.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Referring now to the drawings and in particular to FIG. 1, there is shown a perspective view of an exemplary flip-top, recloseable container having a positive locking arrangement in accordance with an illustrative embodiment of the present invention. In particular, FIG. 1 shows a recloseable container having an outer carton 10 which is a six-sided parallelopiped enclosure formed of three pairs of opposing, generally rectangular walls or panels. More specifically, the carton 10 includes opposing top and bottom walls 12 and 14, opposing front and back walls 16 and 18, and opposing side walls 20 and 22. A liner 24 is contained within the outer carton 10 of the recloseable container.

The side walls 20 and 22 and the relative upper portions of the front wall 16 are provided with horizontal tear strip sections which effectively form an integral and continuous tear strip 26. The tear strip 26 is fairly conventional and located about three panels of the blank used to form the carton 10, as will be described in detail below with reference to FIG. 3.

The tear strip 26 effectively permits a user to conveniently open the recloseable container once it has been filled with the requisite contents and sealed. Tearing or pulling away of the tear strip 26 as indicated in FIG. 1 effectively releases the sealed edges of the side walls 20, 22 and the front wall 16 in order to delineate the container into a bottom base portion generally indicated as 28 and an upper lid or top portion generally indicated as 30. The arrangement is such that, once the tear strip 26 has been completely pulled away, the container lid 30 can be swung or raised upwardly away from the container base 28 by virtue of a hinged attachment of the top wall 12 to the back wall 18 of the carton 10. The liner 24 within the outer carton 10 is exposed where the tear strip 26 has been pulled away.

Figure 2:
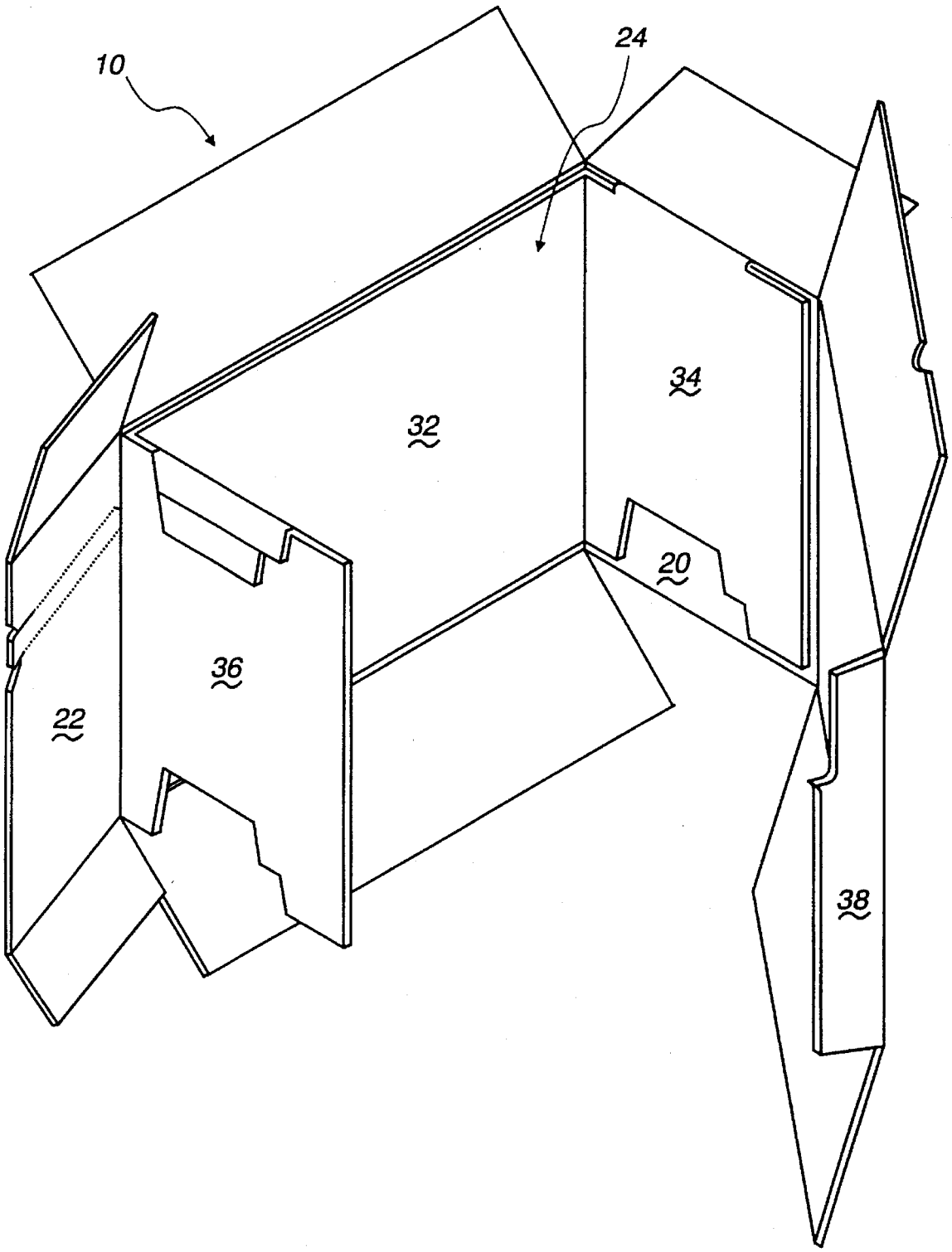
FIG. 2 is a perspective view the recloseable container in FIG. 1 in partially assembled form.

FIG. 2 illustrates the liner 24 of FIG. 1 on the inside of a partially formed carton 10. In one embodiment, the liner 24 is a three-sided structure including a front panel 32 and opposing side panels 34 and 36. Alternatively, the liner may have a four-sided tubular shape including two pairs of opposing, generally rectangular walls. Such a four-sided liner is illustrated and described in U.S. Pat. No. 5,265,799 to Stone, issued Nov. 30, 1993, entitled FLIP-TOP RECLOSEABLE CARTON AND LINER ASSEMBLY, and incorporated herein by reference. The four-sided liner is also illustrated and described in U.S. Pat. No. 5,236,123 to Stone et al., issued Aug. 17, 1993, entitled CARTON AND LINER TEAR-TAPE ASSEMBLY, and incorporated herein by reference. The liner 24 may also be modified to include a partial back wall. Such a "3½" liner includes a front panel, two opposing side panels, and a partial back panel comprised of two non-overlapping flaps extending from each of the side panels.

The liner 24 and carton 10 are designed such that there is a snug fit between the liner 24 and the carton 10. The liner 24 may be adhered to the inside of the carton 10 by a conventional adhesive applied to one or more panels of the liner 24. In the preferred embodiment, the outside surfaces of the liner side panels 34, 36 are partially adhered, by an adhesive such as glue, to the inside surfaces of the respective side walls 20, 22 of the carton 10. The carton 10 includes a glue flap 38 over which the side wall 22 of the carton 10 is secured using the aforementioned adhesive.

Figure 3:
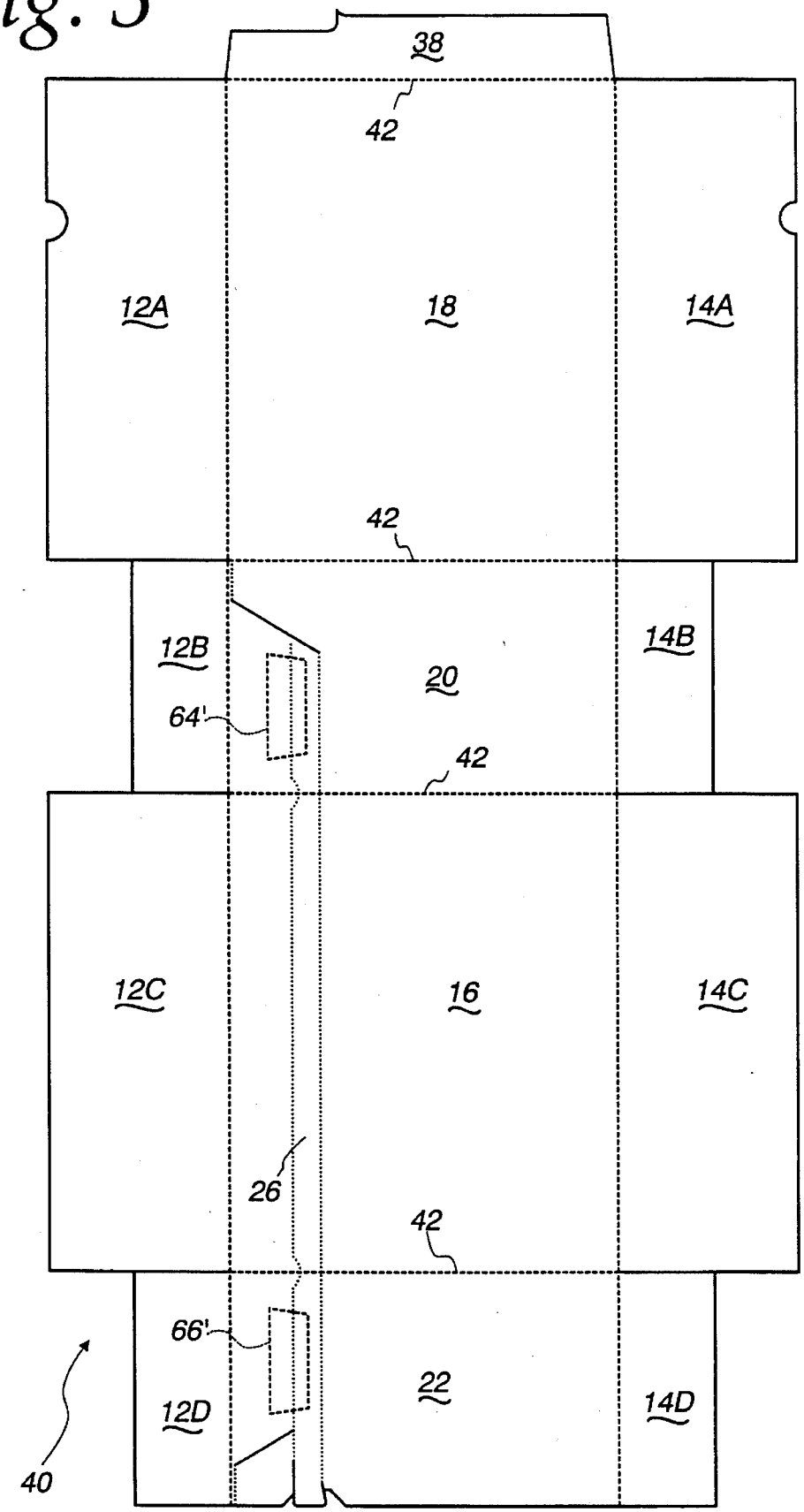
FIG. 3 is a plan view of the inside surface of a paperboard or corrugated blank used to form the outer carton of the recloseable container in FIG. 1.

FIG. 3 illustrates a plan view of the inner surface of a blank used for forming the carton 10 of the recloseable container described above in connection with FIGS. 1 and 2. As shown in FIG. 3, the carton blank 40 is in the form of a single, planar, unitary section of paperboard or corrugated board which includes four vertically aligned, substantially rectangular panels 16, 18, 20, and 22 which are linked to each other by horizontal score lines 42 which facilitate folding of the carton panels relative to each other. With respect to the closed carton in FIG. 1, corresponding pans are indicated by the same reference numerals.

Each of the four main panels comprising the carton blank 40 is provided with a pair of flaps connected along opposing vertical edges by corresponding score lines. More specifically, the back wall panel 18 includes a left end closure flap 12A and a right end closure flap 14A. Similarly, left end and right end dust flaps 12B, 14B are associated with the side wall panel 20, left and right end closure flaps 12C, 14C are associated with the front wall panel 16, and left and right end dust flaps 12D, 14D are associated with the other side wall panel 22. In the illustrative embodiment of FIG. 3, the end closure flaps 12A, 14A, 12C, and 14C have substantially the same vertical and horizontal dimensions (as viewed in FIG. 3), and the end dust flaps 12B, 14B, 12D, and 14D have substantially the same vertical and horizontal dimensions.

The flaps associated with the four main panels interact in a conventional manner to form the top wall 12 and the bottom wall 14 of the carton 10. With respect to the manner in which these flaps interact to form the closed carton shown in FIG. 1, the left end flaps 12A, 12B, 12C, and 12D form the top wall 12, and the right end flaps 14A, 14B, 14C, and 14D form the bottom wall 14.

The back wall panel 18 is provided with the glue flap 38 hingedly connected to back wall panel 18 by means of the horizontal score line 42. In connection with FIG. 2, the inner surface of the side wall panel 22 of the outer carton 10 is adhered to the outer surface of the glue flap 38 by an adhesive such as glue.

In the carton blank 40 illustrated in FIG. 3, the side wall panels 20, 22 and the front wall panel 16 have the tear strip 26 extending integrally across the panels. The design and structure of the tear strip 26 and its operation in effective sealing and convenient tearing-open of a container of the type disclosed herein is fairly conventional and, accordingly, is not described in detail herein. It suffices to state that the tear strip 26 is substantially in the form of a pair of guiding perforation-like (e.g., zipper perforation) or cut-scored parallel lines having a predefined depth of cut (at least about 30 percent) into the outer surface of the side wall panels 20, 22 and the front wall panel 16. The tear strip 26 preferably, but not necessarily, includes a reinforcing tape (not shown) attached to the inner surface of the tear strip 26 to prevent the strip from breaking apart as a result of the strip being removed from the carton 10 during the unsealing operation.

Figure 4:
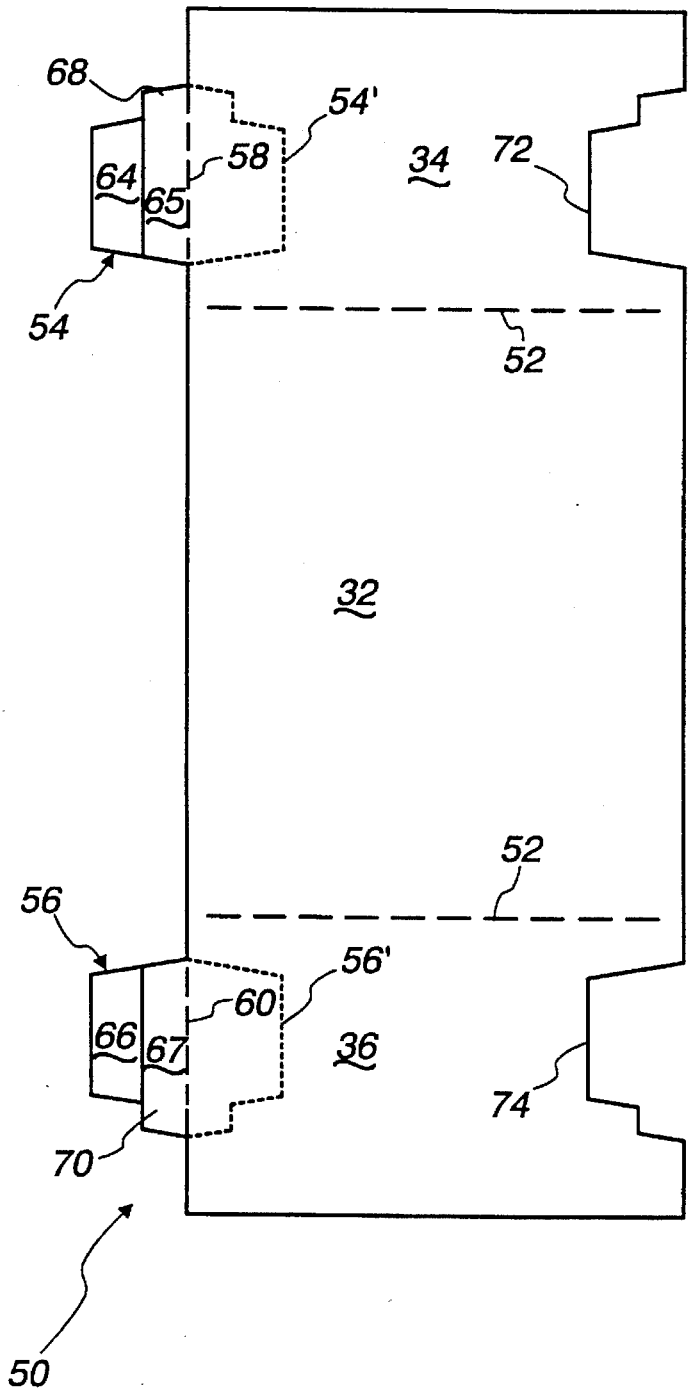
FIG. 4 is a plan view of the inside surface of a paperboard or corrugated blank used to form the inside liner of the recloseable container in FIG. 1.

Referring to FIG. 4, there is depicted a plan view of the inside surface of a liner blank 50 used for forming the liner 24 of the container described above in connection with FIGS. 1 and 2. As illustrated in FIG. 4, the liner blank 50 is in the form of a single, planar, unitary section of paperboard or corrugated board which includes three vertically aligned, substantially rectangular panels 32, 34, and 36 which are linked to each other using horizontal score lines 52 which facilitate folding of the liner panels relative to each other. With respect to the manner in which these panels interact to form the liner 24 shown in FIG. 2, corresponding parts are indicated by the same reference numerals. As stated above, the liner blank 50 may be provided with additional panels for creating a four-sided tubular liner or a "3⅓" liner. While the liner 24 and the carton 10 are illustrated as being formed from separate blanks, the liner 24 and the carton 10 may alternatively be formed from a single, unitary blank with seven main panels of the type described and illustrated in U.S. Pat. No. 5,314,114 to Stone, issued May 24, 1994, entitled FLIP-TOP RECLOSEABLE CARTON WITH POSITIVE CLOSURE ARRANGEMENT, and incorporated herein by reference.

The liner panels are sized so that the liner 24 fits snugly within the carton 10 formed from the carton blank 40 in FIG. 3. Thus, the vertical and horizontal dimensions (as viewed in FIG. 4) of the front panel 32 of the liner blank 50 are slightly smaller than the corresponding dimensions of the front wall panel 16 of the carton blank 40. The side panel 34 of the liner blank 50 has slightly smaller vertical and horizontal dimensions than the corresponding dimensions of the side wall panel 20 of the carton blank 40. Similarly, the side panel 36 of the liner blank 50 has slightly smaller dimensions than the corresponding dimensions of the side wall panel 22 of the carton blank 40. The liner 24 illustrated in FIG. 2 is a full-height liner extending from the top wall to the bottom wall of the carton 10. In an alternative embodiment, the full-height liner 24 is substituted with a partial-height liner extending from the top wall of the carton 10 to a location spaced away from the bottom wall of the carton 10. The panels of such a partial-height liner may, for example, line only an upper one-third to one-half of the carton side wall panels 20, 22 and the carton front wall panel 16.

In accordance with the container of the present invention, the side panels 34, 36 of the liner blank 50 are provided with respective extension flaps 54, 56 which are hingedly connected to the left vertical edges of the respective side panels 34, 36 by respective score lines 58, 60. The extension flap 54 includes a distal island portion 64 and a proximal hinged portion 65 which are linked together by means of weakening "nicks", whereby the distal island portion 64 may easily be separated from the proximal hinged portion 65. Similarly, the extension flap 56 includes a distal island portion 66 and a proximal hinged portion 67 which are connected by weakening nicks so that these two portions may easily be separated.

To save paperboard or corrugated board and increase production throughput, the liner side panels 34, 36 are preferably provided with respective cut-away portions 72, 74 at the right edge of these panels (as viewed in FIG. 4). These cut-away portions 72, 74 are configured in the shape of the respective extension flaps 54, 56 in order to accommodate the extension flaps of a substantially identical liner blank during production. In particular, during production, a unitary sheet of paperboard or corrugated board is cut by die-cutting equipment into a plurality of liner blanks. The cut-away portions 72, 74 allow nesting of the liner blanks during the die-cutting operation, thereby permitting a greater number of liner blanks to be simultaneously formed in the limited cutting area of the die-cutting equipment and, accordingly, increasing production throughput.

Prior to adhering the liner blank 50 to the carton blank 40 as shown in FIG. 2, the extension flaps 54, 56 in FIG. 4 are hingedly rotated 180 degrees about the respective score lines 58, 60 so that the outer surfaces of the respective extension flaps 54, 56 (the surfaces of the extension flaps 54, 56 which are hidden in FIG. 4) are adjacent the outer surfaces of the respective side panels 34, 36. The positions of the extension flaps 54, 56 after they have been folded about the respective score lines 58, 60 are denoted by the reference numerals 54', 56' in FIG. 4. Next, while maintaining the extension flaps 54, 56 in the folded positions 54', 56' using holddown plows on gluing equipment, adhesive is applied to the inner surfaces of the distal island portions 64, 66 of the respective extension flaps 54, 56. Alternatively, the adhesive is applied to the inner surfaces of the carton side wall panels 20, 22 at the positions 64', 66' in FIG. 3. To prevent the hold-down plows from interfering with the application of adhesive, the proximal hinged portions 65, 67 are preferably widened to include respective shoulders 68, 70. The hold-down plows bear against the shoulders 68, 70 to maintain the extension flaps 54, 56 in the folded positions 54', 56' while adhesive is applied to the inner surfaces of the island portions 64, 66. While the hinged portions 65, 67 are illustrated as including one shoulder apiece, each hinged portion may also be provided with an opposing second shoulder which is also held down while adhesive is applied to the associated island portion.

Figure 5:
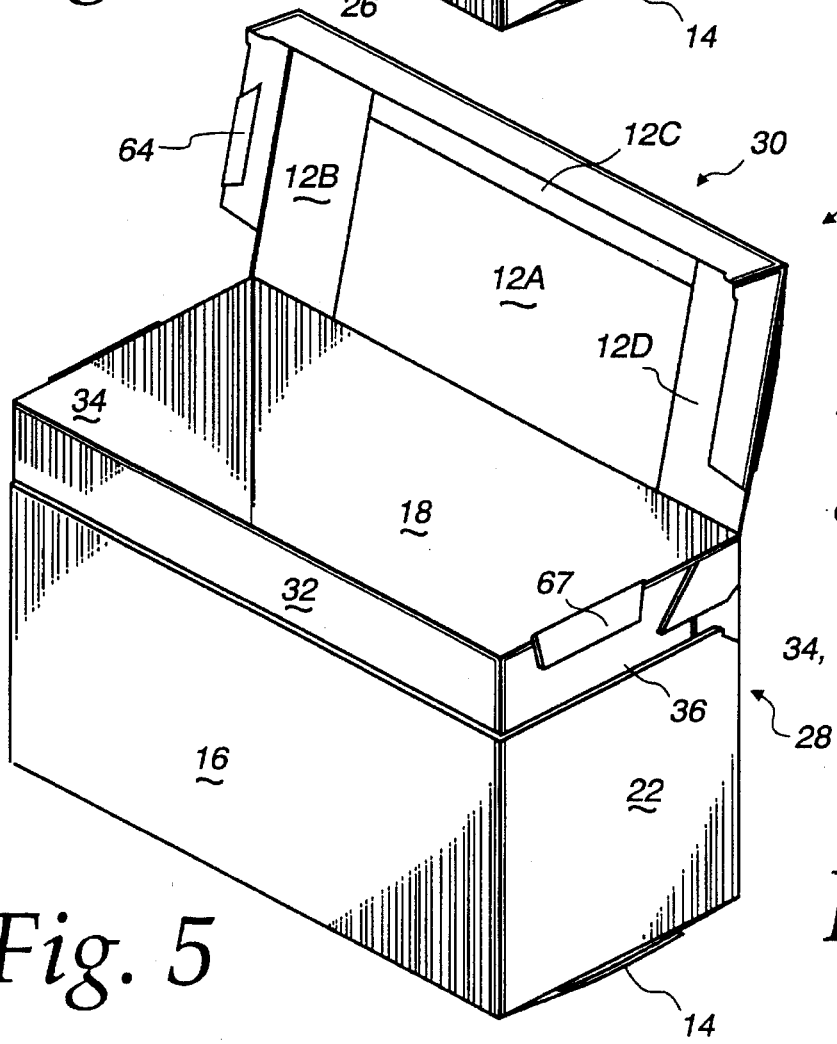
FIG. 5 is a perspective view of the recloseable container in FIG. 1, showing the container in its open form with the lid raised upwardly to open the container.

By adhering the liner blank 50 to the carton blank 40 with the extension flaps 54, 56 in the folded positions 54', 56', the extension flaps 54, 56 are trapped between the respective liner side panels 34, 36 and the respective carton side wall panels 20, 22 (FIGS. 2 and 5). Since the inner surfaces of the island portions 64, 66 of the respective extension flaps 54, 56 have adhesive applied thereto, the inner surfaces of the island portions 64, 66 are fixedly attached to the inner surfaces of the respective carton side wall panels 20, 22 to the left of the tear strip 26 (as viewed in FIG. 3) generally in positions indicated in dashed lines by the respective reference numerals 64', 66' in FIG. 3. The arrangement is such that when the recloseable container in FIG. 1 is formed using the carton and liner blanks of FIGS. 3 and 4 and the container is initially opened by tearing away the tear strip 26 and upwardly raising the lid 30 thereof, the island portions 64, 66 of the respective extension flaps 54, 56 of the liner blank 50 break free of their restricting nicks and remain attached to the lid 30 about the inner surfaces of the respective side wall panels 20, 22 of the carton blank 40 at the respective positions 64', 66' in FIG. 3.

A key advantage with respect to the above-described flap arrangement using the extension flaps 54, 56 is that when the container formed from the blanks 40, 50 is opened by raising the lid 30, the proximal hinged portions 65, 67 are also rotated outwardly and upwardly. Subsequently, when the container is closed by replacing the lid 30 to its initial closed position, the island portions 64, 66 depress the respective hinged portions 65, 67 in a downward direction. More importantly, when the lid 30 is closed down to such an extent that the island portions 64, 66 move down beyond the extension of the respective hinged portions 65, 67, the island portions 64, 66 snap into a locked position and are restrained from upward movement by the confining action of the hinged portions 65, 67 exerted upon the opposing transverse edges of the respective island portions 64, 66.

As a result, the reclosed lid 30 can only be opened by the exertion of a direct force sufficient to snap the island portions 64, 66 back out of engagement with the respective proximal hinged portions 65, 67 by virtue of the upward and outward rotation thereof due to the opening of the lid 30. It will, of course, be recognized that the above-described "snap" action undergone by the island portions 64, 66 relative to the respective hinged portions 65, 67 as the lid 30 of the container is reclosed provides positive tactile as well as audible feedback indicative of effective reclosing and, more importantly, locking of the lid 30 relative to the base section 28 of the container.

It should be noted that the manner in which the container in FIG. 1 is assembled from the carton blank 40 and liner blank 50 is fairly conventional except for the above-described manner according to which the extension flaps 54, 56 are folded and fixedly adhered to the aforementioned portions of the carton side panels. The overall operations involved in assembling the carton blank 40 and the liner blank 50 into the container are well-known to those skilled in the art of packaging containers and is, accordingly, not described in detail herein.

It is sufficient to state herein that the extension flap 54 is first folded 180 degrees about its score line 58 and adhesive is applied to the island portion 64 (or the position 64' in FIG. 3 of the carton side wall panel 20) as described above. Next, the outer surface of the liner blank 50 in FIG. 4 (i.e., the surface hidden from view) is positioned against the inner surface of the carton blank 40 in FIG. 3 with the liner front panel 32 substantially overlapping the carton front wall panel 16 and the liner side panel 34, 36 substantially overlapping the respective carton side wall panels 20, 22. The outer surfaces of the liner side panel 34 is adhered to the inner surface of the carton side wall panel 20 using adhesive applied to the carton side wall panel 20 at positions to the fight of the tear strip 26 in FIG. 3. While attaching the liner side panel 34 to the carton side wall panel 20, the extension flap 54 is trapped between the liner side panel 34 and the carton side wall panel 20 with the inner surface of the island portion 64 adhered to the inner surface of the carton side wall panel 20 at the position 64'.

The liner side panel 36 is then folded 180 degrees about the score line 52 between the liner side panel 36 and the liner front panel 32. Furthermore, the carton back wall panel 18 is folded 180 degrees about the score line 42 between the back wall panel 18 and the side wall panel 20 so that the inner surface of the carton glue flap 38 abuts the outer surface of the liner side panel 36. Next, the extension flap 56 is folded 180 degrees about its score line 60 and adhesive is applied to the island portion 66 (or the position 66' in FIG. 3 of the carton side wall panel 22). After applying adhesive to the outer surface of the glue flap 38 and to the inner surface of the carton side wall panel 22 at positions to the right of the tear strip 26 in FIG. 3, the carton side wall panel 22 is folded 180 degrees about the working score 42 between the carton side wall panel 22 and the carton front wall panel 16 so as to adhere the inner surface of the carton side wall panel 22 to both the outer surface of the glue flap 38 and the outer surface of the liner side panel 36. The extension flap 56 is trapped between the liner side panel 36 and the carton side wall panel 22 with the inner surface of the island portion 66 adhered to the inner surface of the carton side wall panel 22 at the position 66'. At this point, the recloseable container is in finished, glued flat (unerected) form.

The flat container is erected in conventional fashion to form a generally rectangular, four-sided tubular body. After closing and sealing one end (top wall or bottom wall) of the carton 10, the container is filled with the requisite contents prior to closing the remaining end of the carton 10 to yield a closed and entirely sealed container.

Figure 6:
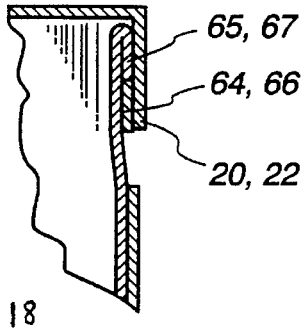
FIG. 6 is a section taken generally along line 6—6 in FIG. 1.
Figure 7:
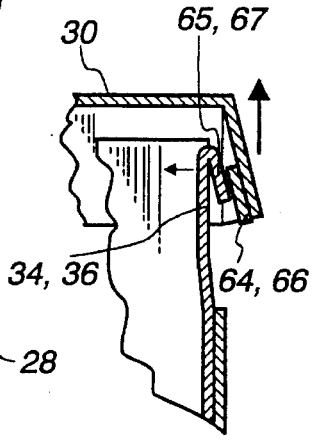
FIG. 7 is a similar section view of the positive locking arrangement showing the container in a partially open condition.

Referring now in particular to FIGS. 5, 6, and 7, there are shown illustrations which facilitate an understanding of the manner in which the positive recloseable locking arrangement functions in accordance with the container embodying the present invention. As particularly shown in the segmented cross-sectional view of FIG. 6, when the carton is in its sealed condition, the island portions 64, 66 remain attached to the respective proximal hinged portions 65, 67 by virtue of the weak nicks through which the elements are linked. In addition, the island portions 64, 66 are permanently adhered to the inner surfaces of the respective carton side wall panels 20, 22. When the tear strip 26 has been torn away and the container is opened by pushing the lid 30 in an upwardly direction (as indicated by the large arrow in the segmented cross-sectional of FIG. 7), the upper transverse edges of the island portions 64, 66 push against the opposing transverse edges of the respective hinged portions 65, 67. When the upward force exerted upon the lid 30 sufficiently forces the proximal hinged portions 65, 67 as well as a portion of the liner side panels 34, 36 to "give" in the general direction of the small arrow (see FIG. 7), the island portions 64, 66 clear the restriction presented thereto by the respective proximal hinged portions 65, 67 and the lid 30 becomes free to be opened. It should be noted that the upward movement of the lid 30 and the island portions 64, 66 initially causes the hinged portions 65, 67 to be hingedly rotated in a upward direction until the upward movement, in combination with the "give" of the hinged portions 65, 67 and the respective liner side panels 34, 36, allows the island portions 64, 66 to clear the respective hinged portions 65, 67.

When the recloseable container is reclosed by closing the lid 30 back to its original position, a similar interaction between the proximal hinged portions 65, 67 and the respective island portions 64, 66 takes place. More specifically, downward movement of the lid 30 causes the island portions 64, 66 attached thereto to move against respective hinged portions 65, 67. As the downward force is continued to be exerted, the island portions 64, 66 cause the respective hinged portions 65, 67 to be hingedly rotated in a downward direction while, at the same time, causing the hinged portions 65, 67 and the liner side panels 34, 36 to again "give" until the island portions 64, 66 completely bypass the respective hinged portions 65, 67 and snap into a locked position with contact between opposing transverse edges of the island portions 64, 66 and the respective hinged portions 65, 67. It is this locking action which produces the above-described positive tactile and audible feedback when the lid 30 has been effectively locked.

A significant advantage of using the above-described structural design for the positive closure arrangement is that it avoids unnecessary board build-up resulting from folding over of liner and carton panel sections in order to define the interlocking elements. More specifically, the interlocking action of these elements, as described above with respect to FIGS. 5–7, is realized with minimal board build-up.

While the present invention has been described with reference to one or more particular embodiments, those skilled in the art will recognize that many changes may be made thereto without departing from the spirit and scope of the present invention.

For example, the extension flaps 54, 56 may be substituted with respective overhanging flaps which are attached to the inner surfaces of the respective liner side panels 34, 36. The liner side panels 34, 36 are then provided with respective die-cut portions, each of which includes a proximal flap and a distal island portion. Each island portion is fixedly adhered to the inner surface of the associated carton side wall panel. At the same time, each island portion is linked to both the associated proximal flap and the surrounding sections of the associated liner side panel by means of weakening "nicks", whereby the distal island portion may easily be separated from both the surrounding sections of the associated side panel and the proximal flap in response to initially opening the container. A die-cut portion and overhanging flap of the above type are described and illustrated in U.S. Pat. Nos. 5,154,343, 5,265,799, and 5,314,114 to Stone, which were previously incorporated herein by reference.

Each of these embodiments and obvious variations thereof is contemplated as falling within the spirit and scope of the claimed invention, which is set forth in the following claims.

What is claimed is:

1. A recloseable container, comprising:

an outer carton including opposing top and bottom walls, opposing front and back walls, and opposing first and second side walls, the first and second side walls and the front wall including a continuous horizontal tear strip for opening up the carton from a sealed form to form a lid hingedly attached to a base section; and a liner constructed and arranged for placement within the carton and including a front panel and opposing first and second side sections for fitting the liner within the carton, the first and second side sections including respective first and second side panels having outer surfaces adjacent inner surfaces of the respective first and second carton side walls, each of the first and second liner side sections including a hinged portion and an island portion disposed in forcibly displaceable mutual engagement such that opening the container lid exerts a force which disengages the mutual engagement between the hinged portion and the island portion, and reclosing the lid leads to snap re-engagement of the hinged portion and the island portion;

wherein the liner and the carton are assembled such that the island portion is fixedly attached to an inner surface of the carton lid and at the same time separatably attached to the hinged portion and wherein opening of the lid separates the island portion from the hinged portion while retaining the hinged portion on the associated liner side section.

2. The recloseable container of claim 1, wherein the snap re-engagement of the hinged portion and the island portion is accompanied by positive tactile and audible feedback.

3. The recloseable container of claim 3 wherein the hinged portion and the island portion are separatably linked to each other about opposing transverse edges thereof, the distal transverse edges of the island portion being separatably attached to the associated liner side section, wherein opening of the carton lid causes the island portion to be separated from the hinged portion and the associated liner side section and be retained on the inner surface of the carton lid.

4. The recloseable container of claim 3 wherein opening of the carton lid causes the opposing transverse edge of the island portion to push against the opposing transverse edge of the hinged portion until the engagement therebetween is released by relative inward movement of the hinged portion and the associated liner side section.

5. The recloseable container of claim 3 wherein reclosing of the carton lid causes re-engagement between the opposed transverse edges of the island portion and the hinged portion by interaction between the hinged portion and the island portion wherein the hinged portion and the associated liner side section undergo relative inward movement until the island portion realizes snap engagement between the opposed transverse edges accompanied by the positive tactile and audible feedback.

6. The recloseable container of claim 1, wherein the first and second liner side sections include respective first and second extension flaps hingedly connected to upper edges of the respective first and second liner side panels, the first extension flap being disposed between the first liner side panel and the first carton side wall, the second extension flap being disposed between the second liner side panel and the second carton side wall, the first and second extension flaps being spaced away from the front panel of the liner, the hinged portion and the island portion of the associated liner side section being formed from the extension flap associated therewith.

7. The recloseable container of claim 6, wherein the respective first and second liner side panels include respective first and second cut-away portions located at the lower edges thereof and spaced away from the front panel of the liner, said first and second cut-away portions being configured in the shape of the respective first and second extension flaps.

8. The recloseable container of claim 1, wherein the carton and the liner are formed from respective unitary blanks.

9. The recloseable container of claim 8, wherein the carton blank is composed of a material selected from the group consisting of corrugated board and paperboard, and wherein the liner blank is composed of a material selected from the group consisting of corrugated board and paperboard.

10. The recloseable container of claim 1, wherein the liner extends substantially from the top wall of the carton to the bottom wall thereof.

11. The recloseable container of claim 1, wherein the island portion and the hinged portion are substantially parallel to the tear strip and are substantially disposed above the tear strip.

12. The recloseable container of claim 1, wherein the hinged portion is wider than the island portion so as to form at least one shoulder relative to the island portion.

13. A recloseable container, comprising:

an outer carton including opposing top and bottom walls, opposing front and back walls, and opposing first and second side walls, the first and second side walls and the front wall including a continuous horizontal tear strip for opening up the container from a sealed form to form a lid hingedly attached to a base section; and a liner constructed and arranged within the carton and including a front panel and opposing first and second side panels for fitting the liner within the carton, the first and second side panels having outer surfaces adjacent inner surfaces of the respective first and second carton side walls, the liner further including first and second extension flaps hingedly connected to upper edges of the respective first and second side panels, the first and second extension flaps being disposed between the respective first and second liner side panels and the respective first and second carton side walls, each of the first and second extension flaps including (i) a hinged portion hingedly connected to the upper edge of the associated liner side panel and (ii) an island portion separatably linked to the hinged portion by weakening nicks, an inner surface of the island portion being fixedly attached to an inner surface of the carton lid;

wherein the hinged portion and the island portion are disposed in forcibly displaceable mutual engagement such that removing the tear strip and opening the carton lid causes the island portion to break free of the weakening nicks and to disengage the mutual engagement, and reclosing the lid leads to snap re-engagement of the hinged portion and the island portion.

14. A recloseable container, comprising:

an outer carton including opposing top and bottom walls, opposing front and back walls, and opposing first and second side walls, the first and second side walls and the front wall including a continuous horizontal tear strip for opening up the carton from a sealed form to form a lid hingedly attached to a base section; and a liner constructed and arranged for placement within the carton and including a front panel and opposing first and second side sections for fitting the liner within the carton, the first and second side sections including respective first and second side panels having outer surfaces adjacent inner surfaces of the respective first and second carton side walls, each of the first and second liner side sections including a hinged portion and an island portion spaced away from the front panel of the liner, the hinged portion and the island portion of each of the first and second liner side sections being disposed in forcibly displaceable mutual engagement such that opening the container lid exerts a force which disengages the mutual engagement between the hinged portion and the island portion, and reclosing the lid leads to snap re-engagement of the hinged portion and the island portion.

15. The recloseable container of claim 14, wherein the respective first and second liner side panels include respective first and second cut-away portions at the lower edges thereof, each of said first and second cut-away portions being spaced away from the front panel of the liner and being configured in the shape of the associated hinged and island portions.

16. The recloseable container of claim 14, wherein the hinged portion is wider than the island portion so as to form at least one shoulder relative to the island portion.

* * * * *